United States Patent [19]

Skvaril

[11] Patent Number: 4,807,410

[45] Date of Patent: Feb. 28, 1989

[54] SELF-CONTAINING PACKAGE SYSTEM FOR STORAGE AND TRANSPORTATION OF PRE-FABRICATED PORTIONS OF A BUILDING STRUCTURE AND THE ASSEMBLY THEREOF

[76] Inventor: Joseph Skvaril, 4807 - 143rd Street, Edmonton, Alberta, Canada, T6H 4C9

[21] Appl. No.: 910,070

[22] Filed: Sep. 22, 1986

[51] Int. Cl.[4] ..... E02D 35/00

[52] U.S. Cl. ..... 52/125.2; 206/321

[58] Field of Search ..... 52/79.5, 143, 125.2; 206/321; 108/53.1

[56] References Cited

U.S. PATENT DOCUMENTS

| | | | |
|---|---|---|---|
| 2,570,234 | 10/1951 | Harris | 206/321 |
| 2,950,078 | 8/1960 | Phillips | 108/53.1 |
| 2,998,132 | 8/1961 | Wilson | 206/321 |
| 3,284,966 | 11/1966 | Bolt | 52/79.5 |
| 3,665,869 | 5/1972 | Howe | 108/53.1 |
| 3,680,273 | 8/1972 | Bigelow | 52/143 |
| 3,752,087 | 8/1973 | Finke | 108/59 |
| 3,756,167 | 9/1973 | Wilson | 108/53.1 |
| 3,895,588 | 7/1975 | Miller | 108/53.1 |
| 4,242,845 | 1/1981 | Osbarne | 52/79.5 |
| 4,283,890 | 8/1981 | Takeda | 52/143 |

*Primary Examiner*—Henry E. Raduazo

*Attorney, Agent, or Firm*—Stanley G. Ade; Murray E. Thrift; Adrian D. Battison

[57] ABSTRACT

A floor or ceiling unit is prefabricated in two halves which can be assembled together to form the unit or one of the halves can be turned upsidedown and nested underneath the other half thus forming a package with upper and lower panels. These panels can be secured together and reduce the overall width of the package to a dimension which is smaller than the maximum allowable width for transportation on world roads. Also included are vertical support members and the pair of perimetrical beams which extend between the vertical support members and means on the beams and support members to receive and support the assembled floor or ceiling unit. The vertical support members and the perimetrical beams can be stored between the joists of the two halves when they are packaged for transportation and a plurality of such packages can be stacked one upon the other upon a truck or the like thus enabling an entire building to be transported readily and easily and within allowable size limits and which can be readily erected on site with the minimum of effort.

17 Claims, 5 Drawing Sheets

SELF-CONTAINING PACKAGE SYSTEM FOR STORAGE AND TRANSPORTATION OF PRE-FABRICATED PORTIONS OF A BUILDING STRUCTURE AND THE ASSEMBLY THEREOF

BACKGROUND OF THE INVENTION

This invention relates to new and useful improvements in pre-fabricated structures and kits therefore, and is an improvement on my U.S. Pat. No. 4,441,286 and constitutes a continuation-in-part of my U.S. patent application Ser. No. 686,829 filed Dec. 27th, 1984.

The present inter-related structure erection/package assembly system allows for the pre-manufacturing or pre-fabrication of relatively large floor/roof structures and their transportation in relatively small sized, self-containing package with useable space therein for storing other prefabricated components or members of the structure such as perimetrical beams, vertical supports and the like.

The structures may be erected readily and easily from the package and of course can be easily expanded in the horizontal and vertical directions or dismantled and transported again in the self-containing component package of minimum size because the floor/roof and wall components may be nested and locked to each other in the package and in the structure they may be connected with the others from the inside thereof while the portions of these components may be connected in a package for transportation, from outside of the package.

The small sized component package is readily transportable anywhere and in any climate because it is self-contained and the nesting construction of the two halves or portions of each floor/roof component adds strength to the package. The structures are rapidly erected, expanded or dismantled, with a relatively small crew of unskilled labour regardless of the size and volume required.

In the present system, a square or rectangular floor/-roof component of any size, with its shorter side being larger than the maximum load width transportable on highways, is split into two or more portions so that this side does not exceed the maximum load width permitted.

Each floor/roof or wall component package includes at least two portions of the structure, one placed in nesting relationship with the other, with the upper portion locking itself by natural gravitation into the lower portion and both creating a self-closing surface on the upper and lower sides enclosed by their roof or floor decks or panels.

In accordance with the invention there is provided a floor/ceiling package for prefabricated structures, said package including two halves, each half including a plurality of spaced and parallel, transverse joists, each including ends, and a planar panel spanning one side of said joists and acting as a floor or ceiling surface, means to detachably secure said halves together along a common junction line to form a floor or ceiling unit, said unit including corners, said junction line extending parallel to said joists, each half having a joist at the common junction line for selectively securing said halves together, vertical support members for each of said corners, a pair of perimetrical beam members situated, spaced and parallel to one another and supported upon pairs of vertical support members and being situated perpendicular to said joists, anchoring support struts extending along the underside of said perimetrical beam members, to support said floor or ceiling unit and means to facilitate engagement of said unit with said perimetrical beam members during assembly, said means including the ends of said joists inclining downwardly and inwardly from the underside of said planar panel towards the lower edges but terminating spaced above said lower edges, to define lower sides of said joists, the ends of said lower sides of said joists also inclining downwardly and inwardly inboard of said first mentioned inclination of said ends of said joists thereby defining horizontal steps therebetween, said first mentioned inclination of said ends of said joists engaging between the upper sides of said spaced and parallel perimetrical beam members and terminating with substantially zero clearance therebetween at the upper ends of said joists and the upper side of said perimetrical beam, when in the assembled position, said inclining lower ends of the lower sides of said joists engaging between the inner edges of said anchoring support struts and terminating with substantially zero clearance therebetween with said step engaging upon said anchoring support struts, when in the installed position.

In accordance with another aspect of the invention there is provided a self-containing package system for prefabricated structures constituting a completed building structure when assembled and a package for storage and/or transportation, when disassembled, and including two similar floor/ceiling halves, at least four vertical support members and at least two perimetrical beam members, each said floor/ceiling halves including a plurality of spaced and parallel transverse joists and a planar panel spanning one side of said joists and acting as a floor or ceiling surface, said package including two said halves, means to detachably secure said halves together along a common junction line to form a completed floor or ceiling unit when assembled, said junction line extending parallel to said joists, each half having a joist at the common junction line for selectively securing said halves together, at least two of said vertical support members being L-shaped in cross-section and constituting L-shaped support members, a first of said perimetrical beam members extending between one of said L-shaped members and another of said support members, a further perimetrical beam member extending between the other of said L-shaped members and the other of said support members and spaced in parallel relationship with said first beam member, means to detachably secure said beam members to said support members, said unit being engageable upon said perimetrical beam members, means on said perimetrical beam members to support said unit and means to detachably secure said unit to said perimetrical beam members, said means to support said unit comprising anchoring support struts secured along the underside of said perimetrical beam members and extending inwardly therefrom and means to facilitate engagement of said unit with said perimetrical beam members during assembly, sad last mentioned means including the ends of said joists inclining downwardly and inwardly from the underside of said planar panel towards the lower edges thereof but terminating spaced above said lower edges to define lower sides, the ends of the lower sides of said joists also inclining downwardly and inwardly inboard of the first mentioned inclining of said ends of said joists, thereby defining a horizontal step therebetween, said first mentioned inclination of said ends of said joists engaging between the upper sides of said spaced and parallel perimetrical beam members and terminating with substantially zero clearance therebetween at the upper ends of said joists and the upper sides of said perimetrical beam members, when in the assembled position, said inclining lower ends of the lower sides of said joists engaging between the inner edges of said anchoring support struts and terminating with substantially zero clearance therebetween, with said step engaging upon said anchoring support struts when in the installed position.

It will also be appreciated that the packages can be stacked one upon the other and thus create a further self-containing unit by securing the bottom deck of each additional package to the top deck of the package below before enclosing the upper package by the upper portion of the floor/roof half or portion.

As the sizes and shapes of the components and connecting details of the self containing package and the expandable and relocable structure are identical, the structure erection and package assembly methods are interrelated and similar with respect to the involvement of labour, tools, screws and nails and the like.

Another aspect of the invention is to provide a high degree of flexibility in choosing type and shape of structures which are simple in construction and economical in manufacture and which regardless of its customized shape, size or building standard can easily be transported in standardized sized self containing packages at lowest possible costs.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the

DETAILED DESCRIPTION

Figure 1:
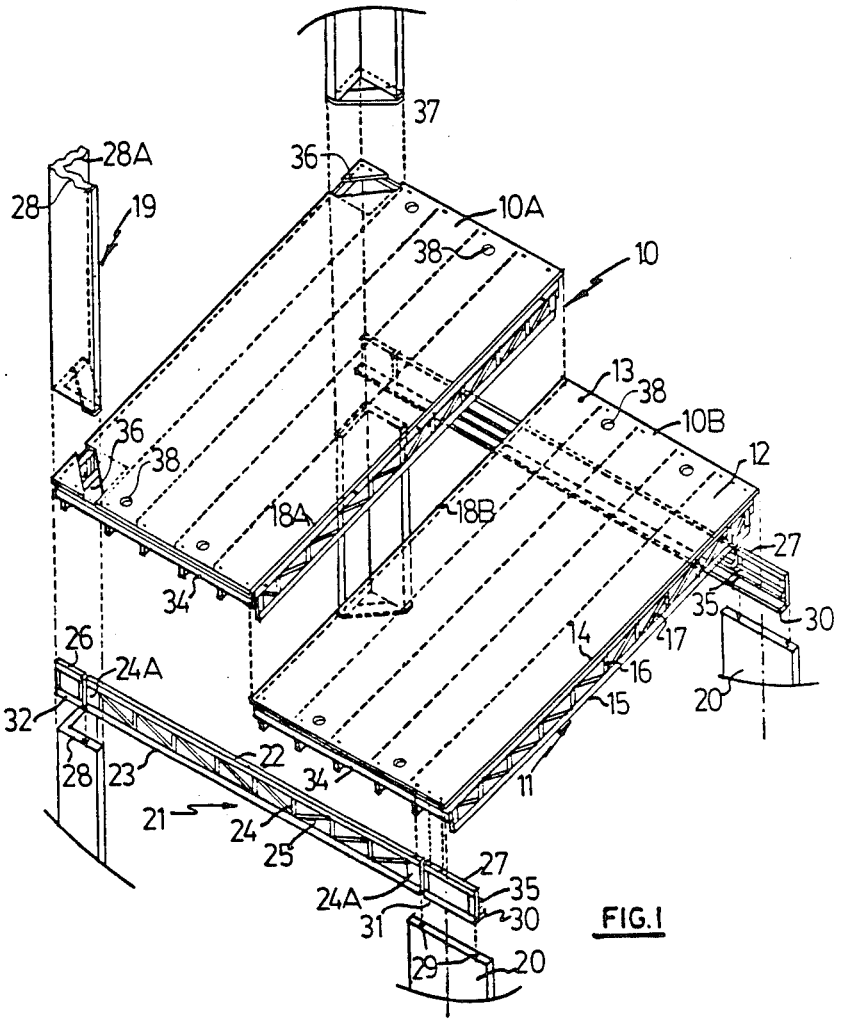
FIG. 1 is an axometric exploded view of the two halves of the floor/roof component and the supporting structure associated therewith.

Proceeding therefore to describe the invention in detail, reference should first be made to FIG. 1 which shows the completed package or kit in its partially assembled form. It consists of a floor/ceiling component collectively designated 10 and consisting, in this embodiment, of two halves 10A and 10B. However it will be appreciated that, depending upon size and design parameters, the component 10 can consist of a plurality of parts but should contain at least two parts.

This component 10 comprises a plurality of spaced and parallel support joists 11 surmounted by a floor or ceiling panel or deck 12 which is secured to the supports by nails, screws or other conventional means and indicated by reference character 13.

In the present embodiment, the support joists are in the form of trusses but of course conventional one piece joists can be used. The trusses incorporate the upper member 14, a lower member 15, vertical struts 16 and diagonal struts 17 all of which are substantially conventional. However, in the claims the term "joists" include both trusses and convention joists.

It will also be noted that the two halves 10A and 10B, when assembled together in side by side relationship include a support in the form of a truss or joist immediately adjacent the inner edges 18A and 18B which facilitates the joining of the two halves together by means of screws or other fasteners such as metal nail connectors on the top of deck 12 or other fasteners (not illustrated).

Two types of vertical support members are shown, namely, L-shaped members 19 and straight or planar members 20. The L-shaped members 19 are specifically provided for corner supports and the planar members 20 for intermediate supports.

These L-shaped members which may be light concrete, metal or wood, are of a height to space a pair of units 10 a sufficient distance apart so that one may act as a ceiling (not illustrated) and the other as a floor as illustrated in FIG. 1.

These are secured to a base (not illustrated) and extend upwardly and adjacent corner members 19 and intermediate members 20 receive a perimetrical beam member collectively designated 21 as will hereinafter be described. These perimetrical beam members include an upper horizontal member 22, a lower horizontal member 23, vertical struts 24 and diagonal struts 25 and are similar in construction to the trusses 11. However the end vertical members 24A are substantially wider than the intermediate members 24 for strength purposes. Perimetrical beam blocks 26 and 27 are provided at each end of the perimetrical beam members 21 to facilitate assembly to the vertical support members 19 and 20. The perimetrical beam block 26 rests on the flange 28 of the corner member which is parallel to the planar member 20 and is of a size that, when installed, the adjacent end of the perimetrical beam member 21 also rests on this flange and can be secured thereto and to the block 26, by means of nails or screws as will hereinafter be described. The same method of attachment occurs with beam block 27 and the adjacent end of the perimetrical beam upon the planar vertical support 20. In other words marks or indicia are provided on the upper edge of the member 20 as indicated by reference character 29 to facilitate the location of the block 27 thereon and leave equal space upon either side for the receipt of the adjacent end of the perimetrical beam 21.

An anchoring support strut 30 is secured to the lower horizontal member 23 of the perimetrical beam and the corresponding member 31 of the block 27 and 32 of the block 26. This extends inwardly and permits nails or screws 33 to be engaged diagonally through the member 30 and into the vertical supports 19 or 20 as shown in phantom in FIG. 3. Once again the block 26 may be secured to the adjacent end of the beam 21 by means of nails or screws as desired.

The perimetrical beam 21 may be manufactured as one piece and its length may be the same or larger as the total width of 10A and 10B. A pair of such perimetrical beams are provided as illustrated in FIG. 1 to receive the unit 10.

Each half of the units 10 includes a perimetrical beam member engaging strut 34 secured to the ends of the joists or trusses 11 perpendicular thereto and between the upper and lower members 14 and 15, it being understood that there is such a strut 34 on each end of both sections 10A and 10B.

Figure 2:
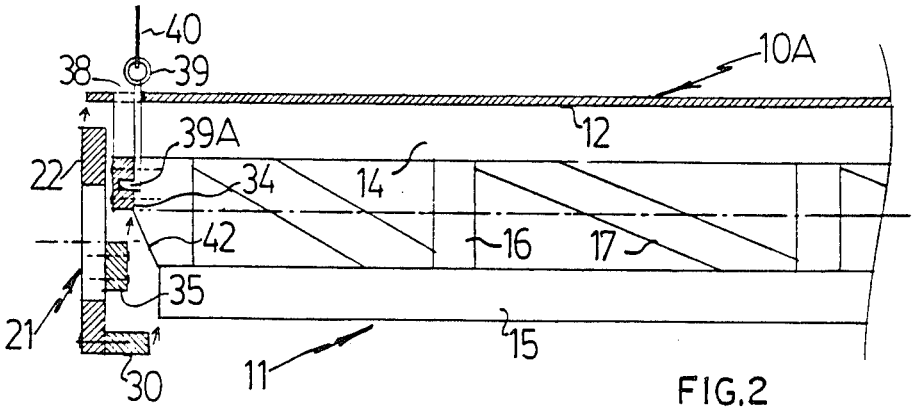
FIG. 2 is a partially exploded and partially cross-sectioned view of the floor/roof unit being engaged upon one of the perimetrical beams.
Figure 3:
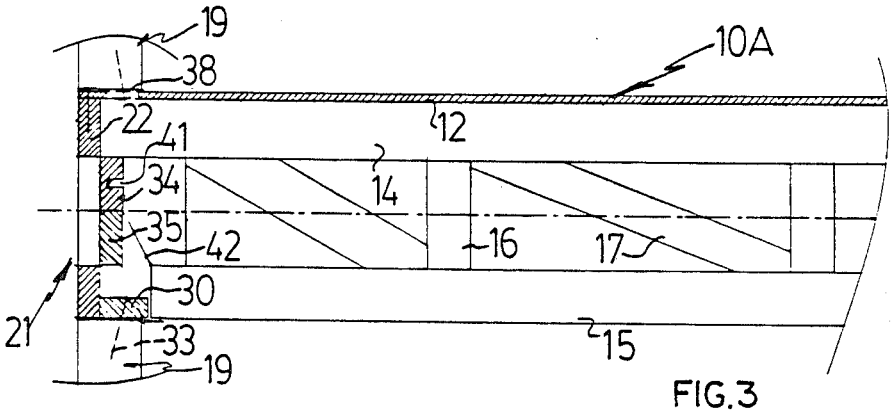
FIG. 3 is a view similar to FIG. 1 but showing the unit engaged with the perimetrical beam which in turn is supported upon one of the vertical components.

A unit engaging strut 35 is secured to the inner face of each of the perimetrical beam members 25 and intermediate the upper and lower members 22 and 23 thereof and parallel therewith so that when the unit 10 is lowered into place, the struts 34 engage upon the struts 35 as clearly shown in FIGS. 2 and 3 and these struts are positioned so that the upper surface of the deck 12 is substantially flush with the upper members 22. When in position, the outer end truss members 11 of the unit 10 complete the perimetrical beam support provided by the perimetrical beams 21 and securement may be effected adjacent the outer corners through diagonal apertures 36 and into the upper members 26 and 14 of the beam blocks and end trusses respectively.

If upper vertical support members are required, these may be engaged adjacent the outer corners of the unit and in this connection diagonal bars or struts 37 are secured to the bottom of flanges 28 and 28A of the corner or L-shaped vertical support members and these struts 37 engage within the diagonal apertures 36 formed in the outer corners of the unit half 10A and may be nailed or otherwise secured to the upper sides of the members 26 and 14. Prior to such erection, any wiring or plumbing at corners 10A can be accessed by operators from the top of deck 12 through these apertures and the same wiring and plumbing may also extend through additional apertures 38 adjacent the support ends of the halves 10A and 10B.

Reference to FIGS. 2 and 3 show the method of assembly and disassembly by the use of lifting hooks 39 attachable to ropes or cables 40 which in turn may be connected to a crane or winch (not illustrated).

The lower ends of these hook elements 39 are angulated as at 39A and engage downwardly through the apertures 38 adjacent the truss ends of the sections 10A and 10B. The hooked ends then engage within apertures 41 formed in the perimetrical beam engaging strips 34 and permit easy lifting of the individual sections.

When being lowered in position as shown in FIG. 2, the angulated or sloped ends 42 of the joists or trusses, act to guide the sections into position so that the strips 34 engage upon strips 35 whereupon securement may be undertaken via nails 33 as hereinbefore described and shown in FIG. 3.

As mentioned previously, the floor/ceiling unit 10 is formed in two or more portions and as an example, the two portions illustrated may each be 4800 mm by 3000 mm so that when they are secured together and installed as shown in FIGS. 1, 2 and 3, the overall size of the floor/ceiling unit 10 becomes 4800 mm by 6000 mm.

In some cases of residential development it would be practicable to split floor component 10 in three portions, each of 8 feet width to match up the width of international standard of containers (total width of 10 is 24 feet).

Either a dividing wall (not illustrated) may be mounted upon the planar vertical supports 20 or, further floor/ceiling panels 10 may be placed to the side of the existing panel or unit terminating of course in two Lshaped members 19 to complete the room unit. Also end walls, doors and windows may be installed in walls attached to the vertical support members all of which is clearly disclosed in my previous U.S. Pat. No. 4,441,286.

One of the major advantages of this invention is the method of an easy erection, expansion or dismantling of structures of customized plan dimensions which are not dictated by the width of load allowable for highway transportation. Also, the system of packaging of the customized structures into standard sized packages and developing their small volumes by nesting and locking complete portions of their floors, or roofs or walls into each other while utilizing the small but long hollow inside spaces for storing other prefabricated structure members such as for example, the perimetrical beams 21 and the vertical support members 19 and 20, together with easy method of securing one self-containing package to the other.

Figure 4:
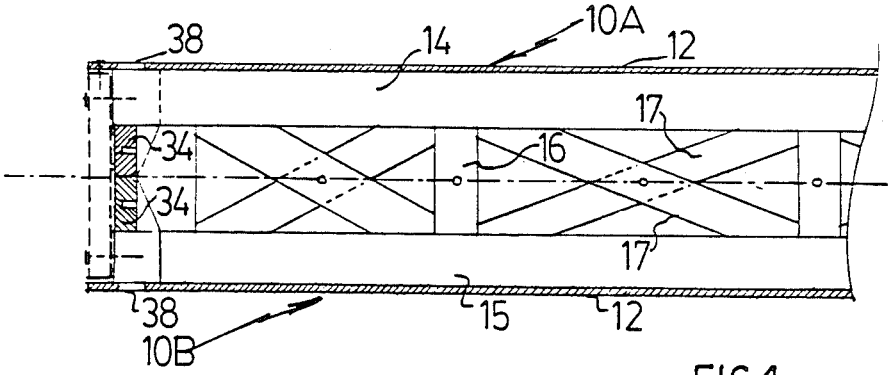
FIG. 4 is a partially cross-sectional view showing the two halves of the unit in nested and locked relationship for transportation and/or storage.
Figure 5:
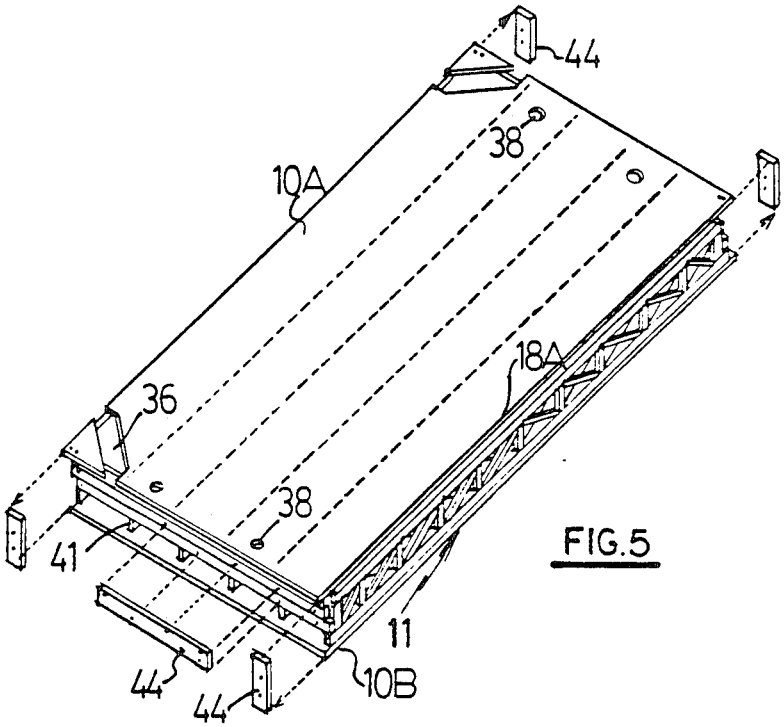
FIG. 5 is an axometric view of the self-contained package with the holding plates shown spaced therefrom for clarity.
Figure 6:
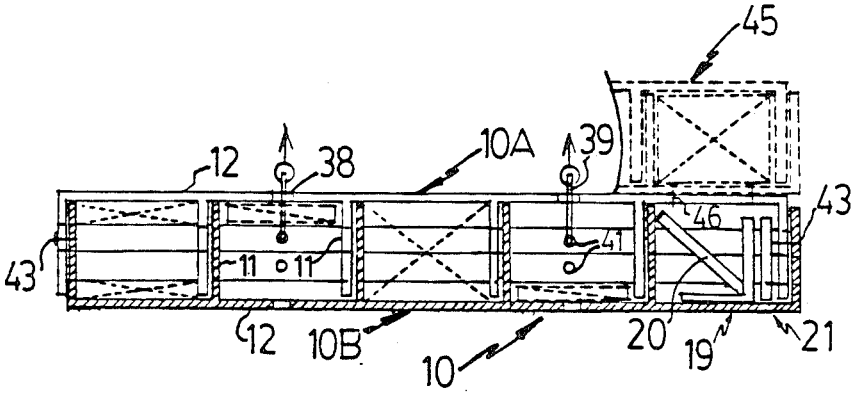
FIG. 6 is a longtitudinal section of FIG. 5.

FIGS. 4, 5 and 6 show details of the packaging concept. Each half or portion of the unit 10 can be nested one within the other by reversing one of the portions through 180° in a vertical plane relative to the other portion so that the joists of this rotated portion face uppermost thus enabling the joists of the first portion to be lowered into nesting engagement with the lower portion as clearly shown in FIGS. 4, 5 and 6 with the beam member engaging struts 34 resting upon one another as clearly shown in FIG. 4 and the joists or trusses being in side by side relationship as clearly shown in FIG. 6.

Screws or other fastening means 43 may be engaged through the vertical or diagonal members of the joists thus holding the sections together and the remaining structure such as the vertical supports 19 and 20 may be stored within the cavities defined by the joists and the upper and lower decks or panels 12.

The lifting hooks 39 can still be engaged through apertures 38 and into the apertures 41 so that the entire package can be lifted from one location to another and to further secure the two portions together, blocks or strips 44, acting as connecting plates, may span the ends of the joists and may be secured thereto by nails or screws as clearly shown in FIG. 5.

Once the first package is located, further packages illustrated in phantom by reference character 45 may be stacked on top of the lower most package so that an entire structure may be stacked and secured one to the other via nails or screws 46 engaged through the lower most deck of one package and into the upper most deck of the next lower most package.

Figure 2A:
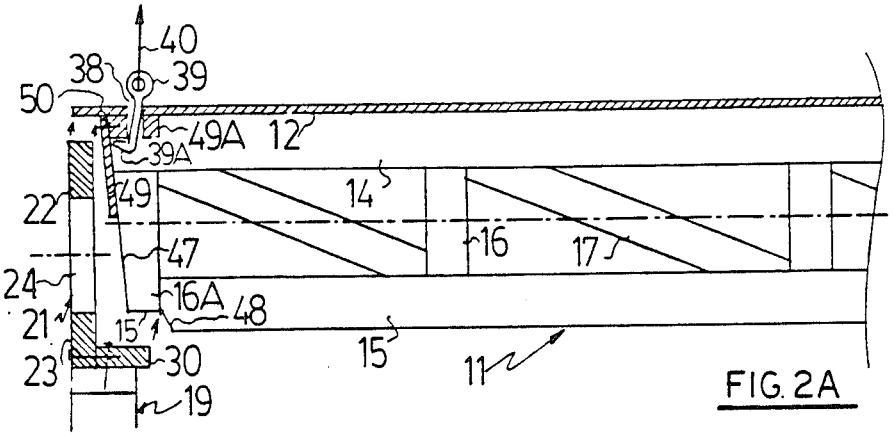
FIG. 2A is a view similar to FIG. 2 but illustrating the preferred embodiment.
Figure 3A:
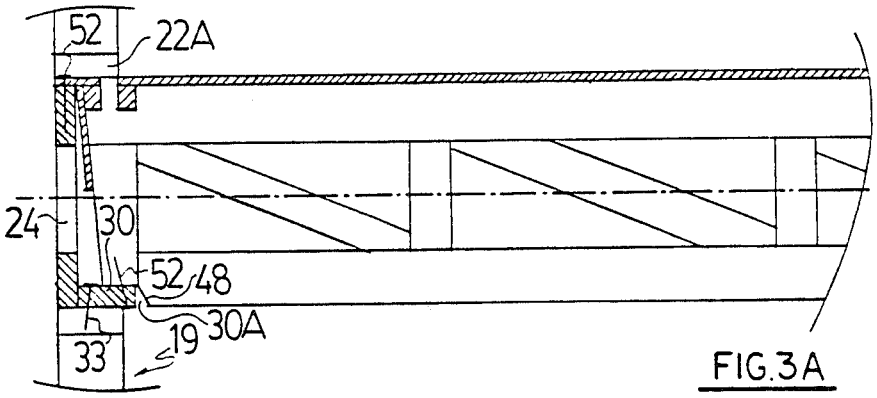
FIG. 3A is a view similar to FIG. 3 but illustrating the preferred embodiment.
Figure 4A:
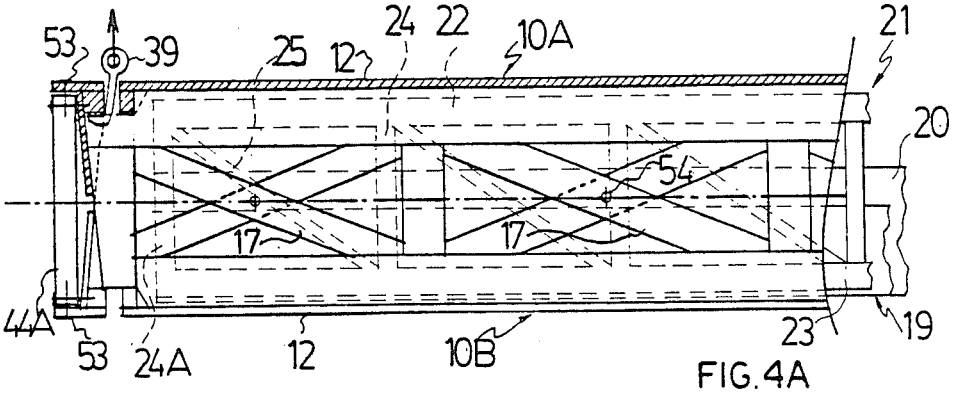
FIG. 4A is a view similar to FIG. 4 but illustrating the preferred embodiment.

The preferred embodiment is illustrated in FIGS. 2A, 3A and 4A and concerns the engagement of the unit with the perimetrical beams 21 in FIGS. 2A and 3A and the engagement of the two portions for forming the package, in FIG. 4A.

In this preferred embodiment, the beam member engaging strut 34 and unit engaging strut 35 are eliminated because the loads from joists 11 are transferred through end struts 16A and members 30 directly to supporting walls 19 which is possible by using boards 49 rather than blocks or struts 34.

The ends of the supports such as the trusses 11 incline downwardly and inwardly as indicated by reference character 47 and the ends of the upper member 14 follows this angulation as clearly shown in FIGS. 2A and 3A.

The ends of the lower members 15 are secured to the lower end members 16A of the supports or trusses 11 and extend downwardly therefrom, the downwardly extending portions also being inclined downwardly and inwardly as indicated by reference character 48.

A board or the like 49 is secured by nails or screws, to the ends of the upper members 14 and extend part way down the sloping portions 47 of the members 16A. The upper edge of this board engages the underside of the panel 12. Blocks or strips 49A are secured to the underside of the panel 12 upon each side of the hook apertures 38 which are inboard slightly from the apertures shown in FIGS. 2 and 3 and the board 49 may be nailed or otherwise secured to one of these blocks as illustrated in FIG. 2A, by reference character 50.

The hook 39 engages through the aperture 38 and under one of the blocks or strips 49 as illustrated in FIGS. 2A and 4A and the sloping relationship of the board 49, the slope 47 of the end struts 16A, and the end portion 48 of the lower member 15 all assist in guiding the unit into position between the opposing perimetrical beams 21. When in position, the narrow horizontal edge 51 of the members 16A engages upon the support struts 30 and nails or other fasteners 52 secure the panel 12 to the upper member 22 of the beams 21 and the struts 30 to the members 16A as clearly shown in FIG. 3A.

When the two halves 10A and 10B of the unit are nested one within the other to form the package, as shown in FIG. 4A, the aforementioned hook 39 may be used to lower the upper half 10A into position with the reversed lower half 10B with the sloping surfaces of the board 49 once again assisting in the positioning of the portions one within the other whereupon end members 44A may be placed between the ends of the panels 12 and fasteners such as screws or nails 53 may secure the halves to the beam members 44A thus securing the halves together as a package, assisted by similar fasteners 54 engaging through the intersections of the diagonal struts 17 of the adjacent situated end trusses so that the hook 39, engaging under blocks 49A, may be used to lift the entire package once the halves are secured together.

It should be noted that the board 49 is relatively thin and assists in securing the rigidity of the floor component during pickup.

It should also be noted that when the unit is lowered into position between the two perimetrical beams 21, the angulated ends or inclination of the supporting joists ensure a smooth positioning of the component and, once in position, substantially zero clearance exists between the upper side of the perimetrical beam and the outer surface of the board 49 as at 22A and between the sloping surface 48 of the lower side of the truss and the upper inner corner of the member 30 of the perimetrical beam as at 30A (FIG. 3A). The preferred embodiment assures transfer of loads from the joists directly to the wall with no opening or with lintels (not illustrated) above openings (applicable in hotels or the like between separating walls), which assures smooth positioning of the floor components with zero tolerance achieved after the floor components are properly positioned and, once this zero tolerance is achieved, the positions of bearing wall, perimetrical beams, and floor/roof components are automatically adjusted.

It should also be noted that the angles or inclinations of the ends of the joists, the thickness of the plates or boards 49, and the heights of the perimetrical beams relate in both the assembled structure and in the "package" or kit configuration.

It will be noted that while the overall standard width of the completed package, designed to be less than the maximum allowable width permissible upon highways, is maintained, with the strength of nested joists a relatively large number of packages may be stacked one upon the other for transportation by ship or container.

When erecting the structure, the following are the steps involved.

Step 1: Once the package is opened, the perimetrical beams 21 stored in the bottom core are placed on support walls or columns depending upon design parameters. If the latter, these can also be stored in the package and are erected first. Each of the beams 21 is an integral part of the floor/roof component as a whole, bearing securely at one end, either both of the halves 10A and 10B of the unit 10 or all of the portions if more than two are involved. If the span between the support walls 20 and columns or L-shaped vertical members 19 is shorter than the length of the bearing members or beams 21 of the floor/roof components, the beam may be stored in the hollow core of the package in one piece. While no span should be longer than the distance between the vertical supports, the module may be substantially longer and the difference between the two may be projected in the lengths of the support walls with the continuity of the perimetrical beam being ensured by additional beam blocks similar to those indicated by reference characters 26 and 27. These can also be stored in the hollow space in the package.

Step 2: After the two halves or plurality of portions of the floor/roof component are positioned in the structure as illustrated in FIGS. 2 and 3 (or 2A and 3A), the perimetrical beam members 21 not only carry the full load but also close that portion of either floor or roof structure. All connecting work such as screwing or nailing of the upper deck of the floor/roof component to the top of the perimetrical beam member or screwing or nailing of the bottom beam block to the top of the either straight or L-shaped vertical wall members is to be done from the inside space of the structure, usually from a small step ladder placed on the lower floor component already in place which is more effective than working from the exterior of the structure. The openings 36 in the deck at the corners of the end portion of the floor/roof component receive the brace for a corner wall for another story to insure that the prefabricated L-shaped vertical member or wall is positioned in all three directions automatically with no measuring or adjusting being necessary. The shaped of the opening 36 is identical to the shape of the brace 37 at the bottom of the next vertical member and the thickness of the deck of the floor/roof components is the same as the thickness of the brace which can if desired, be the portion of the deck that is removed to form aperture 36. This interlocking system also strengthens the structure as a whole while the corner wall lower side of the upper floor can be secured to the top deck of the floor/roof component below by screws or the like once again applied from the inside of the floor or roof component below the top deck.

Step 3: While the vertical walls 20 and columns 19 which support the floor/roof components, may bear load from either one or two structural modules, the perimetrical beam members 21 of one floor/roof component is not statically connected with the beam of the other. The full size floor or roof components can thus be assembled on the ground and the entire floor or roof may be lifted and positioned on the supports as one unit.

The shape of the end details at the engaging strips allow for nesting of two similarly sized components into each other, and both constitute a rigid and strong self-containing package which allows shipment of bulky ceilings in small volume packages with the use of the inside package spaces closed by joists on sides and double engaging strips or end members 44A at the ends of the inside package spaces.

In this package one component prevents the other from sliding in parallel direction with the joists because one component is locked in the other at a zero tolerance when fully nested together which is made possible by the angle of the end detail of the joists. Sliding in one of the directions parallel to the position of the engaging strips is prevented by loading the hollow spaces between the joists with building material and/or supplies, or by nailing a block at the inside face of the engaging strips between the joist of the lower component and the joist of the upper component of the self containing package.

In the structure, the end details of the floor/ceiling components at the engaging strips which allow for their nesting in the package automatically, become the connecting details between each of them and the perimetrical beam or between each of them and the wall in which case the perimetrical beam becomes the means of the physical connection between both (each of them and the wall).

The corner of the floor/ceiling component and the L-shaped corner members have also inter-related structure details. The function of the L-shaped member is to erect structure automatically in the vertical direction with no check of vertical direction control. The brace of the L-shaped corner and the corner opening of the panel positions the L-shaped corner in the two basic horizontal directions. These inter-related structural details ensure that the corner of the panel corresponds with the corner of the L-shaped wall. Tolerances between wall panels are created between the ends of L-shaped wall flanges and the walls, not at the corner.

The braces which lock L-shaped corner wall into the floor/ceiling panel become braces of two or more L-shaped walls in a package.

FIGS. 7 through 10 show a further embodiment of the structure shown in FIGS. 2A, 3A and 4A.

Figure 7:
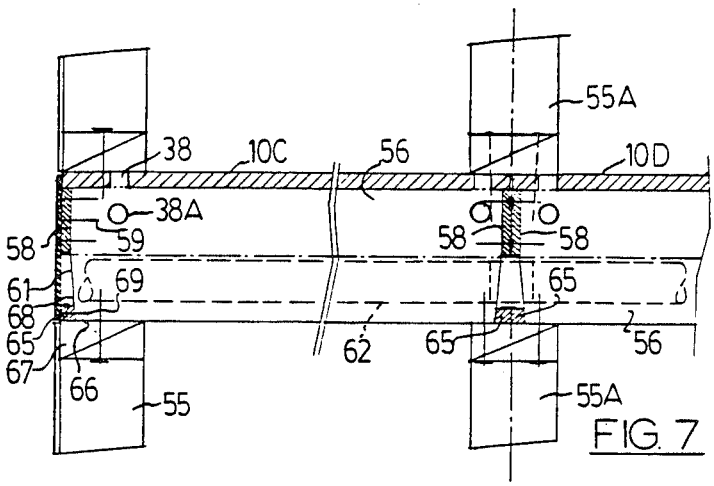
FIG. 7 is a view similar to FIG. 3A but showing an alternative embodiment.

In this particular embodiment the halves or components are indicated by reference characters 10C and 10D shown in FIG. 7 as engaged upon the upper sides of vertical walls 55 when in the installed position.

Each component or half includes the planar panel 12 mounted upon a plurality of spaced and parallel trusses or joists 56, the ends of 57 of which are spanned by joist end plates 58 secured to these ends 57 by nails 59 or similar fastening means.

The joists 56 include the vertical upper end portions 60 and the inwardly and downwardly inclined end portions 61 and elongated ducts 62 are secured against the side face 63 of corresponding joists of each component, by means of fasteners 64. These ducts may be used to carry wiring, plumbing and the like when installed.

Elongated ties 65 are secured along the upper ends 66 of the end walls adjacent the outer sides 67 and when installing the components upon the end walls, the downwardly and inwardly lower portions 61 of the joist ends engage the upper inner corners 68 of these ties which guides the component into position upon the end walls with zero clearance once installed at which point fasteners can be engaged between the tie and the joist end as indicated by reference character 69 in FIG. 7.

Adjacent joist end plates 58 may be secured together by fasteners when installed upon a common vertical wall 55A.

Figure 8:
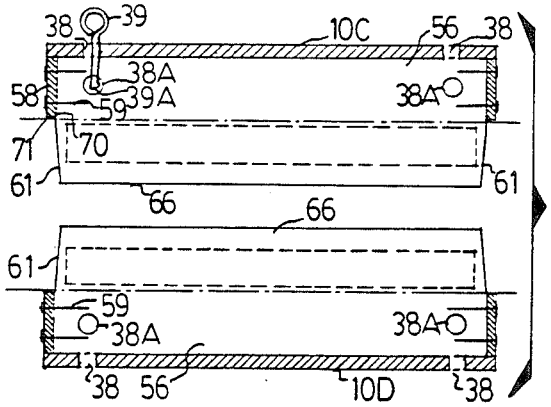
FIG. 8 is an exploded view of FIG. 9.
Figure 9:
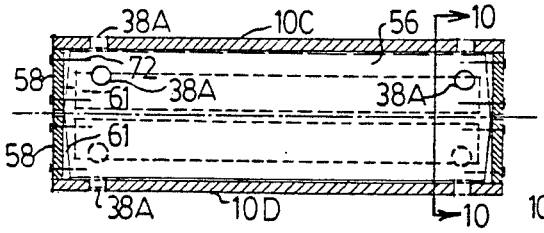
FIG. 9 is a view similar to FIG. 4A but showing the embodiment of FIG. 7.
Figure 10:
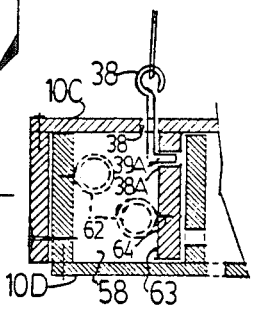
FIG. 10 is a section along the lone 10—10 of FIG. 9.

FIGS. 8, 9 and 10 show the nesting relationship of the two sections when being packaged for storage and/or transportation.

As in the previous embodiments, one component, for example, 10D, is rotated through 180° whereupon the other component 10C is lowered into nesting relationship with the adjacent joists lying side by side with one another. Lifting hooks 39 engage through apertures 38 in panels 10C or D with hooked ends 39A engaging apertures 38A in adjacent joists 56.

In this connection, the sloping lower ends 61 of the joists of each section engage with the inner corners 70 of the lower edges 71 of the joist end plates 58 thus guiding the two components into the nesting relationship shown in FIGS. 9 and 10 whereupon the fasteners 72 may be engaged through the joist end plates of one component and into the ends of the corresponding joist ends of the other component. In this connection it will be noted that the ducts 62 lie one above the other when in the nested relationship but align one with the other when in the installed position shown in FIG. 7.

It will therefore be seen that the present system provides an easy method of construction of floors or roofs because a larger and stronger structure may be built from lighter, but very rigid, pre-fabricated components which are easy to transport and erect. By maintaining continuity of the pre-fabrication between adjacent floors as described, electrical wiring and plumbing may be pre-built in the structural components to a greater degree then is possible in conventional pre-fabricated structures with traditional built floors or roofs.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A prefabricated structure, said structure comprising in combination, two halves, each half including a plurality of spaced and parallel, transverse joists, each including ends, and a planar panel spanning one side of said joists and acting as a floor or ceiling surface, means to detachably secure said halves together along a common junction line to form a floor or ceiling unit, said unit including corners, said junction line extending parallel to said joists, each half having a joist at the common junction line for selectively securing said halves together, vertical support members for each of said corners, a pair of perimetrical beam members situated, spaced and parallel to one another and supported upon pairs of vertical support members and being situated perpendicular to said joists, anchoring support struts extending along the underside of said perimetrical beam members, to support said floor or ceiling unit and means to facilitate engagement of said unit with sad perimetrical beam members during assembly, said means including the ends of said joists inclining downwardly and inwardly from the underside of said planar panel towards the lower edges but terminating spaced above said lower edges, to define lower sides of said joists, the ends of said lower sides of said joists also inclining downwardly and inwardly inboard of said first mentioned inclination of said ends of said joists thereby defining horizontal steps therebetween, said first mentioned inclination of said ends of said joists engaging between the upper sides of said spaced and parallel and perimetrical beam members and terminating with substantially zero clearance therebetween at the upper ends of said joists and the upper side of said perimetrical beam, when in the assembled position, said inclining lower ends of the lowersides of said joists engaging between the lower ends of the lower sides of said joists engaging between the inner edges of said anchoring support struts and terminating with substantially zero clearance therebetween with said step engaging upon said anchoring support struts, when in the installed position.

2. The invention according to claim 1 which includes lifting hook access apertures through said panel and lifting hook engaging means under said panel adjacent said apertures.

3. The invention according to claim 2 in which said lifting hook engaging means includes a relatively thin board secured to the upper portion of the downwardly and inwardly inclining ends of said joists, the upper edge of said board engaging the underside of said panel inboard of the edge thereof thereby defining a ledge between said board and said panel edge, said ledge engaging upon the upper side of said perimetrical beam members when installed.

4. The invention according to claim 2 in which said lifting look engaging means includes a block secured adjacent the outer side of said hook access aperture and to the under side of the portion of said panel defining said outer side of said aperture.

5. The invention according to claim 3 in which said lifting look engaging means includes a block secured adjacent the outer side of said hook access aperture and to the under side of the portion of said panel defining said outer side of said aperture.

6. A kit of parts comprising a self-contained package of parts for assembly into a building structure, said kit comprising two similar floor/ceiling halves, at least four vertical support members and at least two perimetrical beam members, each said floor/ceiling halves including a plurality of spaced and parallel transverse joists and a planar panel spanning one side of said joists and acting as a floor or ceiling surface, said package including two said halves, means adapted to detachably secure said halves together along a common junction line to form a completed floor or ceiling unit when assembled, said junction line extending parallel to said joists, each half having a joist at the common junction line adapted to secure said halves together, at least two of said vertical support members being L-shaped in cross-section and constituting L-shaped support members, a first of said perimetrical beam members adapted to extend between one of said L-shaped members and another of said support members a further perimetrical beam member adapted to extend the other of said L-shaped members and the other of said support members in spaced in parallel relationship with said first beam member, means adapted to detachably secure said beam members to said support members, said unit being adapted to engage upon said perimetrical beam members, means on said perimetrical beam members adapted to support said unit and means adapted to detachably secure said unit to said perimetrical beam members, said means adapted to support said unit comprising anchoring support struts secured along the underside of said perimetrical beam members and extending inwardly therefrom and means adapted to facilitate engagement of said unit with said perimetrical beam members during assembly, said last mentioned means including the ends of said joists inclining downwardly and inwardly from the underside of said planar panel towards the lower edges thereof by terminating spaced above said lower edges to define lower sides, the ends of the lower sides of said joists also inclining downwardly and inwardly inboard of the first mentioned inclining of said ends of said joists, thereby defining a horizontal step therebetween, said first mentioned inclination of said ends of said joists adapted to engage between the upper sides of said spaced and parallel perimetrical beam members and terminating with substantially zero clearance therebetween at the upper ends of said joists and the upper sides of said perimetrical beam members, when in the assembled position, said inclining lower ends of the lower sides of said joists adapted to engage between the inner edges of said anchoring support struts and terminating with substantially zero clearance therebetween, with said step adapted to engage upon said anchoring support struts when in the installed position.

7. The kit according to claim 6 which includes lifting hook access apertures through said panel and lifting hook engaging means under said panel adjacent said apertures.

8. The kit according to claim 11 in which said halves are adapted to nest one within the other to form said package, when separated one from the other, one of said halves being reversed and rotated vertically through 180° relative to the other half and adapted to be placed whereby said joists of one half nest against corresponding joists of the other half so that said planar panels from upper and lower enclosure surfaces of said package, and means adapted to detachably secure said halves together to form said package.

9. The kit according to claim 7 in which said halves are adapted to nest one within the other to form said package, when separated one from the other, one of said halves being reversed and rotated vertically through 180° relative to the other half and adapted to be placed whereby said joists of one half nest against corresponding joists of the other half so that said planar panels form upper and lower enclosure surfaces of said package, end members adapted to be detachably secured to the ends of said panels perpendicular to said joists, and means adapted to detachably secure said halves together to form said package.

10. The kit according to claim 6 which said lifting hook engaging means includes a relatively thin board secured to the upper portion of the downwardly and inwardly inclining ends of said joists, the upper edge of said board adapted to engage the underside of said panel inboard of the edge thereof thereby defining a ledge between said board and said panel edge, said ledge adapted to engage upon the upper side of said perimetrical beam members when installed.

11. The kit according to claim 9 which said lifting hook engaging means includes a relatively thin board secured to the upper portion of the downwardly and inwardly inclining ends of said joists, the upper edge of said board engaging the underside of said panel inboard of the edge thereby defining a ledge between said board and said panel edge, said ledge engaging said end members when in the nested position.

12. The kit according to claim 7 in which said lifting look engaging means includes a block secured adjacent the outer side of said hook access aperture and to the under side of the portion of said panel defining said outer side of said aperture.

13. A kit of parts comprising a self-contained package of parts for assembly into a building structure, said kit comprising a pair of similar floor/ceiling components, at least four vertical support members and at least two perimetrical beam members, each floor/ceiling component including a plurality of spaced and parallel transverse joists and a planar panel spanning one side of said joists and acting as a floor or ceiling surface, adapted to engage upon said perimetrical beam members by the ends of said joists when installed, means adapted to detachably secure said components together along a common junction line, to form a unitary floor or ceiling surface, said junction line extending perpendicular to said joists, a vertically situated joist end plate spanning the upper portions of the ends of said joists, the lower portions of the ends of said joists inclining downwardly and inwardly and a means on said vertical supports adapted to guide said components into position terminating with zero clearance between the inclined lower ends of said joists and said last mentioned means, when in the installed position.

14. The kit according to claim 13 in which said last mentioned means comprises a wall tie secured along the outer upper edge of said perimetrical beam members.

15. The kit according to claim 13 in which said floor/ceiling components are adapted to nest one within the other to form said package, when disassembled, one of said components being reversed and rotated vertically through 180° relative to the other component and placed whereby said joists of one component nest against corresponding joists of the other component so that said planar panels from upper and lower enclosure surfaces of said package and said joist end plates constitute the enclosed ends of said package, and means adapted to detachably secure said components together to form said package and further means adapted to facilitate the engagement of one component in nesting relationship with the other.

16. The kit according to claim 15 in which said last mentioned means comprises said inwardly and downwardly inclined lower ends of said joists of each component adapted to engage the lower horizontal edges of said joint end plate of the other corresponding component terminating in substantially zero clearance when said lower horizontal edges of said joist end plates, abut one another.

17. The kit according to claim 13 which includes a duct section secured along one side of one of said joists of each section, said ducts adapted to align one with the other when said components are in the installed position and are adapted to be spaced one above the other when said components are in the nested position.

* * * * *